US011660865B2

(12) United States Patent
Kim et al.

(10) Patent No.: US 11,660,865 B2
(45) Date of Patent: May 30, 2023

(54) PRINT HEAD UNIT AND INKJET PRINTER INCLUDING THE SAME

(71) Applicant: Samsung Display Co., Ltd., Yongin-si (KR)

(72) Inventors: Kyong Sub Kim, Yongin-si (KR); Geun Tak Kim, Yongin-si (KR); Jae Hoon Kim, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 99 days.

(21) Appl. No.: 17/445,171

(22) Filed: Aug. 16, 2021

(65) Prior Publication Data

US 2022/0097370 A1 Mar. 31, 2022

(30) Foreign Application Priority Data

Sep. 25, 2020 (KR) ..... 10-2020-0125226

(51) Int. Cl.
*B41J 2/14* (2006.01)

(52) U.S. Cl.
CPC .. *B41J 2/14201* (2013.01); *B41J 2002/14419* (2013.01)

(58) Field of Classification Search
CPC ..... B41J 2/14201; B41J 2002/14419; B41J 2/14209; B41J 2/14; B41J 2/01; B41J 2/14048; B41J 2/175; B41J 2/17563; H01L 21/67144; H01L 21/6715; H01L 25/0753
See application file for complete search history.

(56) References Cited

U.S. PATENT DOCUMENTS

| | | | | |
|---|---|---|---|---|
| 6,786,577 | B2 | 9/2004 | Tamahashi et al. | |
| 7,763,108 | B2 | 7/2010 | Oyanagi et al. | |
| 9,833,994 | B2 | 12/2017 | Nishimura et al. | |
| 2003/0020788 | A1* | 1/2003 | Asano | B41J 2/175 347/85 |

FOREIGN PATENT DOCUMENTS

KR 10-0761343 B1 9/2007

OTHER PUBLICATIONS

IP.com search (Year: 2023).*

* cited by examiner

*Primary Examiner* — Lisa Solomon
(74) *Attorney, Agent, or Firm* — Lewis Roca Rothgerber Christie LLP

(57) ABSTRACT

An Inkjet printer includes a substrate on a stage. A print head unit is positioned above the stage and discharges an ink on the substrate. The print head unit includes a manifold for guiding movement of the ink in a first direction therein. A head block is under the manifold and includes a plurality of channels connected to the manifold and piezoelectric elements adjacent to the channels to discharge the ink through the channels. A nozzle unit is under the head block and includes nozzles corresponding to the channels. A dispersion plate is between the manifold and the head block and disperses the ink in a second direction intersecting the first direction to supply the ink to the head block. Resistance plates are between the dispersion plate and the head block, are formed parallel substantially to the second direction, and prevent the ink from flowing in the first direction.

15 Claims, 8 Drawing Sheets

PRINT HEAD UNIT AND INKJET PRINTER INCLUDING THE SAME

CROSS-REFERENCE TO RELATED APPLICATION

The present application claims priority to and the benefit of Korean Patent Application No. 10-2020-0125226 filed in the Korean Intellectual Property Office on Sep. 25, 2020, the entire content of which is incorporated herein by reference.

BACKGROUND

1. Field

Aspects of some embodiments of the present invention relate to a print head unit and an inkjet printer including the same.

2. Description of the Related Art

As interests in information displays and demands on using portable information media increase, researches and commercialization on display devices are actively performed.

The above information disclosed in this Background section is only for enhancement of understanding of the background and therefore the information discussed in this Background section does not necessarily constitute prior art.

SUMMARY

Aspects of some embodiments of the present invention include a print head unit capable of uniformly supplying light-emitting elements to a substrate, and an inkjet printer including the same.

An inkjet printer according to some embodiments of the present invention includes a substrate on a stage; a print head unit positioned above the stage and configured to discharge an ink to the substrate; and an ink supply unit configured to supply the ink to the print head unit, wherein the print head unit includes: a manifold configured to guide movement of the ink in a first direction therein; a head block under the manifold and including a plurality of channels connected to the manifold and piezoelectric elements adjacent to the channels to discharge the ink through the channels; a nozzle unit under the head block and including nozzles corresponding to the channels; a dispersion plate between the manifold and the head block and configured to disperse the ink in a second direction intersecting the first direction to supply the ink to the head block; and resistance plates between the dispersion plate and the head block, formed parallel substantially to the second direction, and configured to prevent the ink from flowing in the first direction.

According to some embodiments, the ink may include a solid dispersed in a solvent, and the solid may be at least one selected from light-emitting elements, quantum dots, and color filter materials, each of which has a diameter or a length ranging from a nanoscale to a microscale.

According to some embodiments, a first surface of the dispersion plate adjacent to the manifold may be inclined along the second direction, and the ink supplied to the dispersion plate may be supplied between the dispersion plate and the head block along the first surface.

According to some embodiments, a second surface of the dispersion plate adjacent to the head block may include a central portion and a peripheral portion positioned in the second direction with respect to the central portion, the central portion may be higher than the peripheral portion with respect to an upper surface of the head block, and the resistance plates may be at the central portion.

According to some embodiments, the resistance plates may be arranged at an equal interval along the first direction.

According to some embodiments, a length of the dispersion plate in the first direction may be greater than a length of the head block in the first direction, and the dispersion plate may cover the head block in the first direction.

According to some embodiments, some of the resistance plates may be adjacent to both sides of the dispersion plate in the first direction.

According to some embodiments, a distance between the resistance plates in an area adjacent to a side of the dispersion plate in the first direction may be different from a distance between the resistance plates in an area adjacent to a central portion of a planar area of the dispersion plate.

According to some embodiments, the resistance plates may be integrally formed with the dispersion plate.

According to some embodiments, the resistance plates may be formed by bending from a mother substrate parallel to a lower surface of the dispersion plate, and the mother substrate may be coupled to the dispersion plate.

According to some embodiments, the print head unit may further include a filter between the manifold and the dispersion plate.

A print head unit according to some embodiments of the present invention includes a manifold configured to guide movement of an ink in a first direction therein; a head block under the manifold and including a plurality of channels connected to the manifold and piezoelectric elements adjacent to the channels to discharge the ink through the channels; a nozzle unit under the head block and including nozzles corresponding to the channels; a dispersion plate between the manifold and the head block and configured to disperse the ink in a second direction intersecting the first direction to supply the ink to the head block; and resistance plates between the dispersion plate and the head block, formed parallel substantially to the second direction, and configured to prevent the ink from flowing in the first direction.

According to some embodiments, a first surface of the dispersion plate adjacent to the manifold may be inclined along the second direction, and the ink supplied to the dispersion plate may be supplied between the dispersion plate and the head block along the first surface According to some embodiments, a second surface of the dispersion plate adjacent to the head block may include a central portion and a peripheral portion positioned in the second direction with respect to the central portion, the central portion may be higher than the peripheral portion with respect to an upper surface of the head block, and the resistance plates may be at the central portion.

According to some embodiments, the resistance plates may be arranged at an equal interval along the first direction.

DETAILED DESCRIPTION

Figure 1:
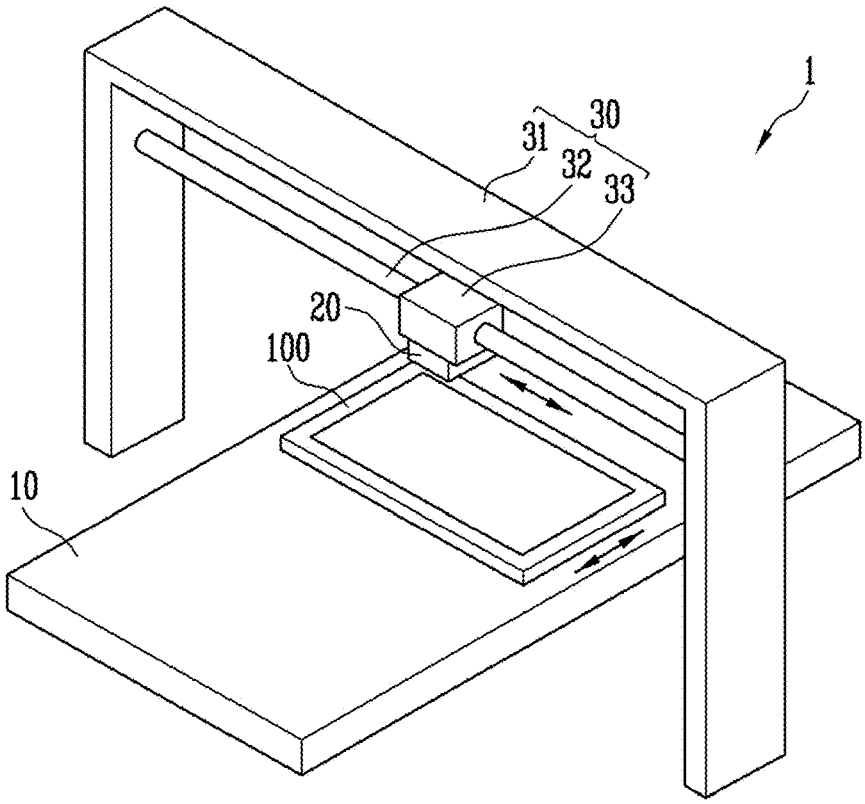
FIG. 1 is a schematic perspective view illustrating an inkjet printer according to some embodiments.

While aspects of some embodiments of the present invention are open to various modifications and alternative embodiments, aspects of some embodiments thereof will be described and illustrated by way of example in the accompanying drawings. However, it should be understood that there is no intention to limit the present invention to the particular example embodiments disclosed, and, on the contrary, embodiments according to the present invention include all modifications, equivalents, and alternatives falling within the spirit and scope of embodiments according to the present invention.

Like numbers refer to like elements throughout the drawings. In the accompanying drawings, the sizes of structures may be exaggerated for clarity. Although the terms "first", "second", etc. are used herein to describe various elements, these elements should not be limited by these terms. The terms are used only for the purpose of distinguishing one element from another. For example, without departing from the scope of the present invention, a first element could be termed a second element, and similarly a second element could be also termed a first element. A single form of expression is meant to include multiple elements unless otherwise stated.

It will be understood that the terms "comprises" and/or "comprising," or "includes" and/or "including," when used in this specification, specify the presence of stated features, integers, steps, operations, elements, components, and/or combinations thereof but do not preclude the presence or addition of one or more other features, integers, steps, operations, elements, components, and/or combinations thereof. In addition, when a layer, a film, an area, or a plate is referred to as being "on" or "under" another layer, another film, another area, or another plate, it can be "directly" or "indirectly" on the other layer, film, area, plate, or one or more intervening layers may also be present. Further, in the present invention, when a part of a layer, a film, an area, a plate, and the like is formed on another part, a direction, in which the part is formed, is not limited only to an up direction, and includes a lateral direction or a down direction. On the contrary, it will be understood that when an element such as a layer, film, area, or plate is referred to as being "beneath" another element, it can be directly beneath the other element or intervening elements may also be present.

In the present application, when it is described that an element (such as a first element) is "operatively or communicatively coupled with/to" or "connected" to another element (such as a second element), the element can be directly connected to the other element or can be connected to the other element through another element (e.g., a third element). On the contrary, when it is described that an element (e.g., a first element) is "directly connected" or "directly coupled" to another element (e.g., a second element), it means that there is no intermediate element (e.g., a third element) between the element and the other element.

Hereinafter, aspects of some embodiments of the present invention will be described in more detail with reference to the accompanying drawings. In the following description, the singular forms "a," "an," and "the" are intended to include the plural forms as well, unless the context clearly indicates otherwise.

FIG. 1 is a schematic perspective view illustrating an inkjet printer according to some embodiments.

Referring to FIG. 1, an inkjet printer 1 (or printing device) includes a stage 10 and a print head unit 20. In addition, the inkjet printer 1 may further include a moving unit 30.

The stage 10 may support the substrate 100. The stage 10 may be made of a rigid material, but the material of the stage 10 is not limited thereto. The stage 10 may have a rectangular parallelepiped shape, but the shape of the stage 10 is not limited thereto.

According to some embodiments, the stage 10 may be configured to move the substrate 100 using a rail or the like.

A substrate 100 may be located on the stage 10. The substrate 100 is a substrate constituting a display panel that displays images. For example, the substrate 100 may include a base substrate, a thin film transistor, an insulating layer, and the like. The substrate 100 will be described in more detail below with reference to FIG. 2.

The print head unit 20 is located above the stage 10 and may discharge (or spray) an ink on the substrate 100.

The moving unit 30 may be coupled to the print head unit 20 and may move the print head unit 20. According to some embodiments, the moving unit 30 may include a support part 31 for supporting the print head unit 20, a guide part 32 coupled to the support part 31 to guide the movement of the print head unit 20, and a coupling part 33 coupled to the print head unit 20 and movable along the guide part. According to some embodiments, the inkjet printer 1 may further include an ink supply unit (for example, an ink tank 40 illustrated in FIG. 3) that supplies an ink to the print head unit 20 and may further include a control unit that controls the operation of the moving unit 30 (and the stage 10, ink supply unit, and the like).

Figure 2:
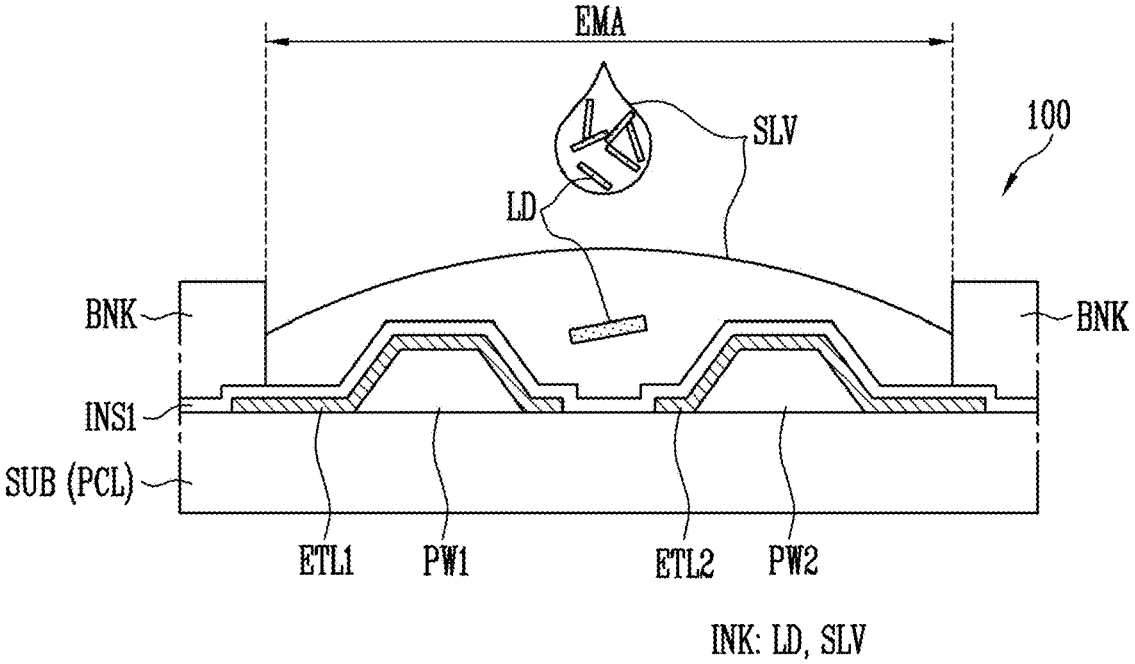
FIG. 2 is a cross-sectional view illustrating a substrate used in the inkjet printer of FIG. 1 according to some embodiments.

FIG. 2 is a cross-sectional view illustrating a substrate used in the inkjet printer of FIG. 1. In FIG. 2, the substrate 100 is briefly illustrated in relation to an ink INK supplied from the inkjet printer 1. For example, a substrate 100 is briefly illustrated based on one pixel of a display panel.

The substrate 100 may include a base substrate SUB, first and second bank patterns PW1 and PW2, first and second electrodes ETL1 and ETL2, a first insulating layer INS1, and a bank BNK.

The base substrate SUB may include a transparent insulating material to transmit light. The base substrate SUB may be a rigid substrate or a flexible substrate. The rigid substrate may be, for example, one of a glass substrate, a quartz substrate, a glass ceramic substrate, and a crystalline glass substrate. The flexible substrate may be one of a film substrate and a plastic substrate which include a polymer organic material.

According to some embodiments, the base substrate SUB may include a pixel circuit layer PCL, or the pixel circuit layer PCL may be located on the base substrate SUB.

The pixel circuit layer PCL may include a plurality of insulating layers, and semiconductor patterns and conductive patterns which are located between the plurality of insulating layers. Here, the semiconductor pattern and the conductive pattern may constitute a transistor, a capacitor, and lines connected thereto. The transistors, the capacitors, and the lines may constitute a pixel circuit that allows light-emitting elements LD to be described below to emit light. That is, transistors and the like may be located on the base substrate SUB as a pixel circuit for allowing the light-emitting elements LD to emit light.

First and second bank patterns PW1 and PW2 may be located on the base substrate SUB (or pixel circuit layer PCL) and may be spaced apart from each other.

The first and second bank patterns PW1 and PW2 may be positioned in an emission area EMA. In order to guide light emitted from the aligned light-emitting elements LD to an upward direction of the substrate 100, the first and second bank patterns PW1 and PW2 operate as support members which support the first and second electrodes ETL1 and ETL2 so as to change surface profiles (or cross-sectional shapes) of the first and second electrodes ELT1 and ETL2. That is, the first and second bank patterns PW1 and PW2 may change the surface profile of the first and second electrodes ELT1 and ETL2.

The first and second bank patterns PW1 and PW2 may be inorganic insulating films including an inorganic material or organic insulating films including an organic material. According to some embodiments, the first and second bank patterns PW1 and PW2 may include a single organic insulating film and/or a single inorganic insulating film, but embodiments according to the present invention are not limited thereto. According to some embodiments, the first and second bank patterns PW1 and PW2 may be provided in the form of a multi-film in which at least one organic insulating film and at least one inorganic insulating film are stacked. However, the material of the first and second bank patterns PW1 and PW2 is not limited to the above-described example embodiments, and according to some embodiments, the first and second bank patterns PW1 and PW2 may include a conductive material.

Each of the first and second bank patterns PW1 and PW2 may have a trapezoidal cross section of which a width is gradually decreased toward an upper portion thereof, but embodiments according to the present invention are not limited thereto. According to some embodiments, each of the first and second bank patterns PW1 and PW2 may include a curved surface with a cross section having a semi-ellipse shape, or a semi-circle shape (or hemispherical shape) of which a width is gradually decreased upward from one surface of the substrate SUB.

The first and second electrodes ETL1 and ETL2 may be located on the first and second bank patterns PW1 and PW2.

Each of the first and second electrodes ETL1 and ETL2 may be made of a material having certain reflectance in order to allow light emitted from the light-emitting elements LD to travel in an image display direction of a display device. Each of the first and second electrodes ETL1 and ETL2 may be made of a conductive material having certain reflectance. According to some embodiments, each of the first and second electrodes ETL1 and ETL2 may include an opaque metal, and the opaque metal may include, for example, a metal such as silver (Ag), magnesium (Mg), aluminum (Al), platinum (Pt), palladium (Pd), gold (Au), nickel (Ni), neodymium (Nd), iridium (Ir), chromium (Cr), titanium (Ti), or an alloy thereof. According to some embodiments, each of the first and second electrodes ETL1 and ETL2 may include a transparent conductive material, and the transparent conductive material may include a conductive oxide such as indium tin oxide (ITO), indium zinc oxide (IZO), zinc oxide (ZnO), indium gallium zinc oxide (IGZO), or indium tin zinc oxide (ITZO), or a conductive polymer such as poly(3,4-ethylenedioxythiophene) (PEDOT). When each of the first and second electrodes ETL1 and ETL2 includes a transparent conductive material, a separate conductive layer made of an opaque metal may be added to reflect light emitted from the light-emitting elements LD in the image display direction of the display device.

Each of the first and second electrodes ETL1 and ETL2 may be provided and/or formed as a single-film, but embodiments according to the present invention are not limited thereto. According to some embodiments, each of the first and second electrodes ETL1 and ETL2 may be provided and/or formed as a multi-film in which at least two or more materials of metals, alloys, conductive oxides, and conductive polymers are stacked. As an example, each of the first and second electrodes EL1 and EL2 may be formed as a multi-film in which ITO, silver (Ag), and ITO are sequentially stacked.

A first insulating layer INS1 may be located between the first electrode EL1 and the second electrode EL2.

The first insulating layer INS1 may include an inorganic insulating film made of an inorganic material or an organic insulating film made of an organic material. As an example, the first insulating layer INS1 may include at least one selected from metal oxides such as silicon nitride ($SiN_x$), silicon oxide ($SiO_x$), silicon oxynitride ($SiO_xN_y$), and aluminum oxide ($AlO_x$), but embodiments according to the present invention are not limited thereto. According to some embodiments, the first insulating layer INS1 may be formed as an organic insulating film that may enable planarizing support surfaces of the light-emitting elements LD.

The bank BNK may be a structure defining (or partitioning) the emission area (this is, an area of each of the pixels provided on the display panel) and may be, for example, a pixel defining film. The bank BNK may include at least one light-blocking material and/or reflective material to prevent light leakage defects in which light (or light) leaks between the emission area EMA and other emission areas.

The ink INK may be supplied to the emission area EMA of the above-described substrate 100 using the inkjet printer 1 (see FIG. 1). The ink INK may be a mixture including a fluid solvent SLV and the plurality of light-emitting elements LD included (or dispersed) in the solvent SLV.

The light-emitting element LD may have a shape extending in one direction. When it is assumed that an extending direction of the light-emitting element LD is a length direction, the light-emitting element LD may have one end portion (or lower end portion) and the other end portion (or upper end portion) in the extending direction. The light-emitting element LD may include semiconductor layers located at both end portions thereof and an active layer located between the semiconductor layers in the length direction. The active layer may emit light having a wavelength of 400 nm to 900 nm.

The light-emitting element LD may be provided in various shapes. As an example, the light-emitting element LD may have a rod-like shape or a bar-like shape which is long in a length direction thereof (i.e., has an aspect ratio greater than one). The light-emitting element LD may include, for example, a light-emitting diode (LED) manufactured in a very small size to such an extent as to have a diameter and/or a length ranging from a nanoscale to a microscale.

For example, the diameter of the light-emitting element LD may be in a range of about 0.5 μm to about 500 μm, and the length thereof may be in a range of about 1 μm to about 10 μm. However, the diameter and length of the light-emitting element LD are not limited thereto, and the size of the light-emitting element LD may be changed to meet the requirements (or design conditions) of a lighting device or a self-luminous display device to which the light-emitting element LD is applied.

After the light-emitting elements LD are supplied to the emission area EMA, an alignment signal may be applied to the first and second electrodes ETL1 and ETL2 to form an electric field between the first electrode ELT1 and the second electrode ETL2, thereby aligning the light-emitting elements between the first electrode ELT1 and the second electrode ETL2 due to the electric field. The solvent SLV may be volatilized or removed through other methods after the light-emitting elements LD are aligned, thereby finally aligning the light-emitting elements on the substrate 100.

Meanwhile, in FIG. 2, it has been described that the inkjet printer 1 (see FIG. 1) supplies the ink INK to the substrate 100 and the ink INK includes light-emitting elements LD, but the ink INK is not limited thereto. For example, instead of the light-emitting elements LD, the ink INK may include a light conversion material (for example, a quantum dot) that converts a wavelength of light emitted from the light-emitting elements LD into a specific wavelength and re-emits the light or a color filter material that blocks or transmits only a specific wavelength of light emitted from the light-emitting elements LD. The light conversion material (for example, the quantum dot) and the color filter material may have a diameter and/or length ranging from a nanoscale to a microscale similar to the light-emitting element LD. That is, the ink INK may include a nanoscale or microscale solid in the solvent SLV.

Figure 3:
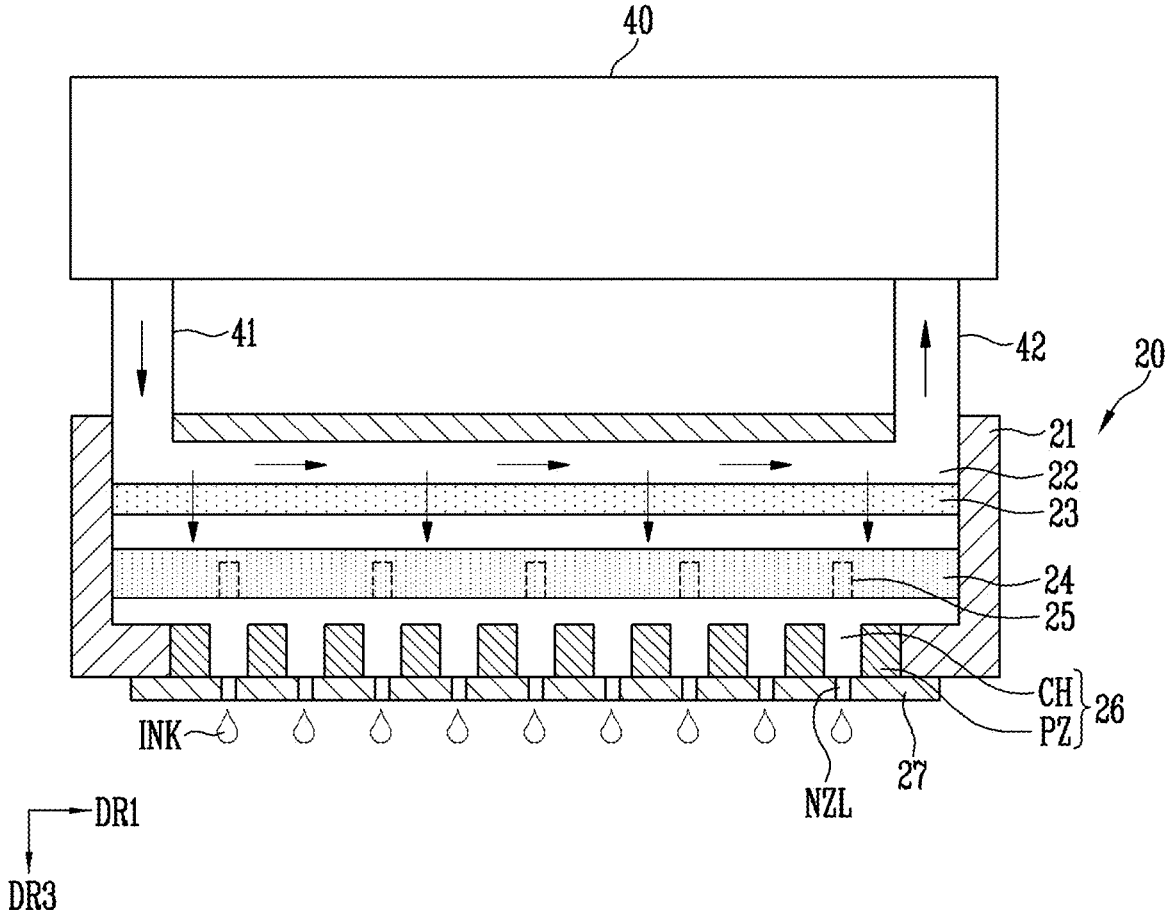
FIG. 3 is a cross-sectional view illustrating an example of a print head unit included in the inkjet printer of FIG. 1 according to some embodiments.
Figure 4:
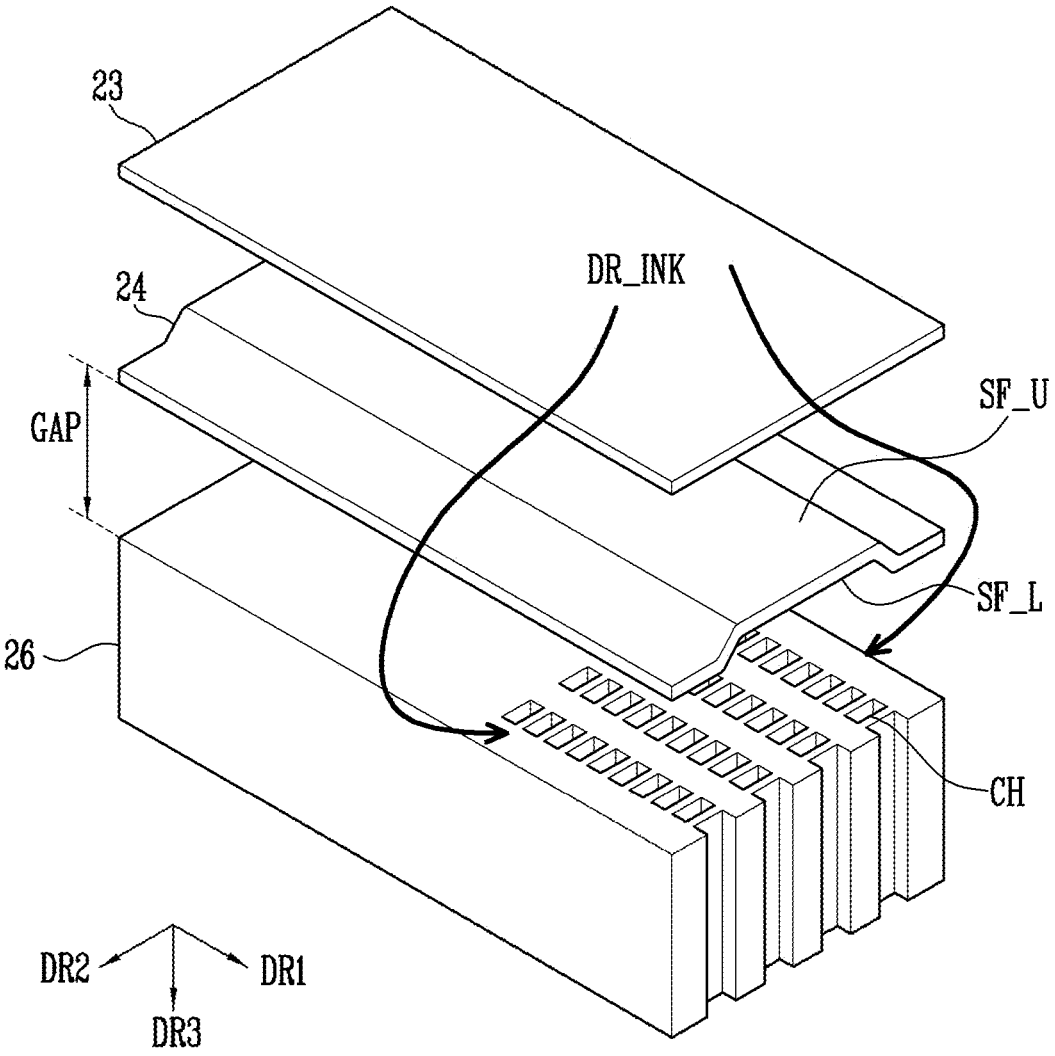
FIG. 4 is a schematic perspective view illustrating the print head unit of FIG. 3 according to some embodiments.
Figure 5:
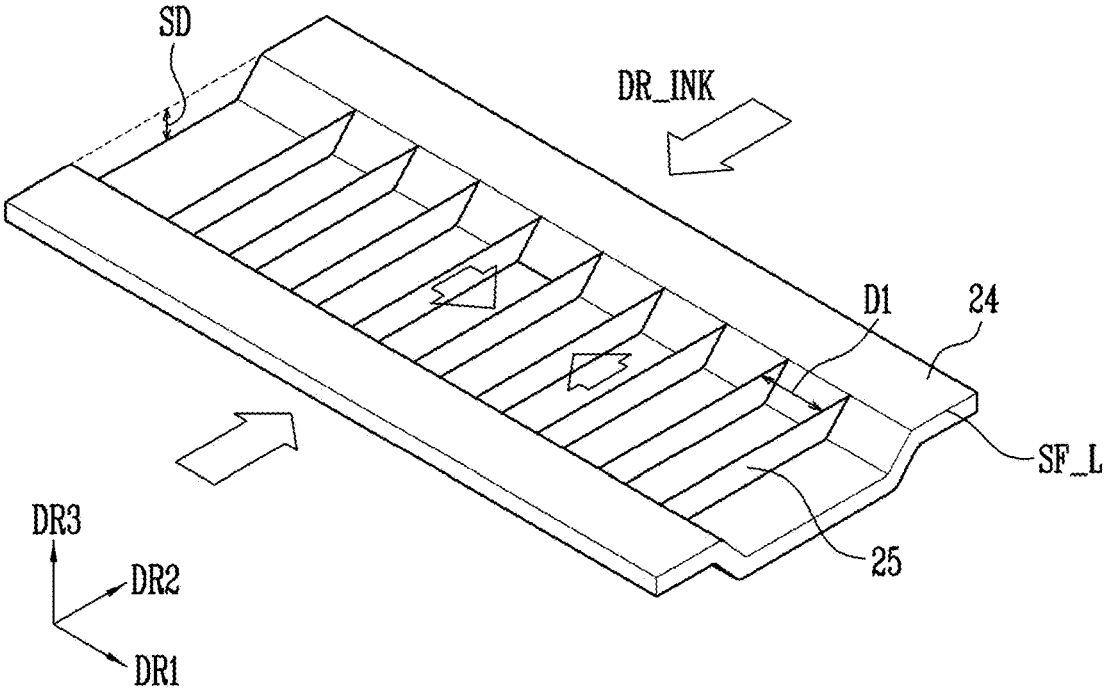
FIG. 5 is a perspective view illustrating an example of resistance plates included in the print head unit of FIG. 4 according to some embodiments.

FIG. 3 is a cross-sectional view illustrating an example of a print head unit included in the inkjet printer of FIG. 1. FIG. 4 is a schematic perspective view illustrating the print head unit of FIG. 3. FIG. 4 schematically illustrates a print head unit 20 based on a filter 23, a dispersion plate 24, and a head block 26 provided in a main body 21 of the print head unit 20. FIG. 5 is a perspective view illustrating an example of resistance plates included in the print head unit of FIG. 4. For convenience of description, resistance plates 25 are illustrated in FIG. 5 based on a state in which the dispersion plate 24 of FIG. 4 is turned over by an angle of 180°.

Referring to FIGS. 1 to 3, the print head unit 20 may be connected to an ink tank 40 (or ink storage unit) through first and second transmission pipes 41 and 42. The ink tank 40 may store an ink INK and may supply the ink INK to the print head unit 20 through the first transmission pipe 41 (and an inlet). The remaining ink INK after being discharged from the print head unit 20 may be supplied or returned to the ink tank 40 from the print head unit 20 through the second transmission pipe 42 (and an outlet). That is, the ink INK may pass through the first transmission pipe 41, and a portion may be discharged from the print head unit 20, and a portion may be recycled back into the ink tank 40 through the second transmission pipe 42.

Each of the first and second transmission pipes 41 and 42 may be formed of a flexible hose, but embodiments according to the present invention are not limited thereto. The first and second transmission pipes 41 and 42 may be provided to have various configurations within a range capable of stably moving the ink INK.

The ink tank 40 and the first and second transmission pipes 41 and 42 may collectively constitute or be referred to as an ink supply unit, although according to some embodiments the ink supply unit may include additional components without departing from the spirit and scope of embodiments according to the present disclosure.

The print head unit 20 may include the main body 21 having an empty space therein, a manifold 22 formed or provided in the main body 21, the filter 23, the dispersion plate 24, the resistance plates 25 (or flow resistance plates), the head block 26, and a nozzle unit 27.

The manifold 22 may have a space formed in a first direction DR1, may be connected to the first and second transmission pipes 41 and 42, and may guide the movement of the ink INK in the first direction DR1 therein. In addition, the manifold 22 may supply the ink INK in a third direction DR3 (that is, a downward direction in which the filter 23 or the like is positioned).

The filter 23 may be located under the manifold 22 (that is, in the third direction DR3 with respect to the manifold 22) and may filter foreign substances contained in the ink INK. The filter 23 may prevent nozzles NZL of the nozzle unit 27 from being clogged by the foreign substances contained in the ink INK. For example, the filter 23 may be a mesh plate including a plurality of fine openings.

The dispersion plate 24 may be positioned under the filter 23 (that is, in the third direction DR3 with respect to the filter 23) and may disperse the ink INK in a second direction DR2 intersecting the first direction DR1 to supply the ink INK to the head block 26. In addition, the dispersion plate 24 may be spaced apart from the head block 26 by a distance (e.g., a set or predetermined distance) GAP, and the ink INK dispersed and introduced through a relatively narrow gap between the dispersion plate 24 and the head block 26 may apply uniform pressure to an upper surface of the head block 26. That is, the dispersion plate 24 can equalize the supply pressure of the ink INK. For example, the distance (e.g., the set or predetermined distance) GAP may be about 150 μm but is not limited thereto.

For reference, when the print head unit 20 does not include the dispersion plate 24, the ink INK supplied to the head block 26 from the manifold 22 through the filter 23 may apply greater pressure to a specific portion of the head block 26 (for example, a portion adjacent to the second transmission pipe 42) in a direction (that is, the first direction DR1) in which the ink INK is moved in the manifold 22, thereby causing a deviation in discharge amount of the ink INK (or ink discharge amount) discharged from the head block 26. In order to prevent or reduce variations in discharge amounts of the ink INK, the dispersion plate 24 may supply the ink INK to the head block 26 by dispersing the ink INKL in the second direction intersecting the movement direction (that is, the first direction DR1) in which the ink INK flows in the manifold 22.

According to some embodiments, a first surface SF_U (that is, an upper surface) of the dispersion plate 24 may be inclined in the second direction DR2 with respect to on one surface of the filter 23 (or, upper surface of the head block 26). In this case, the ink INK supplied through the filter 23 may be supplied between the dispersion plate 24 and the head block 26 along the first surface SF_U of the dispersion plate 24.

As illustrated in FIG. 4, the first surface SF_U of the dispersion plate 24 may have a shape inclined from a center portion thereof in the second direction DR2 and a direction opposite to the second direction DR2. The ink INK may be moved in an ink movement direction DR_INK (or ink supply direction) illustrated in FIG. 4 along the shape of the first surface SF_U of the dispersion plate 24 and may be introduced onto an upper surface of the head block 26 through the gap between the dispersion plate 24 and the head block 26.

According to some embodiments, a second surface SF_L of the dispersion plate 24 may include a central portion and a peripheral portion positioned in the second direction DR2 with respect to the central portion, and the central portion may be higher that the peripheral portion with respect to the upper surface of the head block 26.

As illustrated in FIG. 5, the second surface SF_L of the dispersion plate 24 has a shape of which a central portion is recessed, and the central portion of the second surface SF_L may have a step difference SD from a peripheral portion of the second surface SF_L. For example, the step difference SD may be about 800 μm but is not limited thereto.

The resistance plates 25 may be located under the dispersion plate 24, and each of the resistance plates 25 may be formed substantially parallel to the second direction DR2. The resistance plates 25 may prevent the ink INK from flowing in the first direction DR1 under the dispersion plate 24 (that is, the first direction DR1 substantially perpendicular to the second direction DR2 in which the ink INK is supplied from the dispersion plate 24). The resistance plates 25 may be made of a rigid material.

As illustrated in FIG. 5, the resistance plates 25 may be located at the central portion of the second surface SF_L of the dispersion plate 24. Each of the resistance plates 25 may have a height (that is, a height in the third direction DR3) corresponding to the step difference SD between the central portion and the peripheral portion of the dispersion plate 24 and may have a shape extends in the second direction DR2. According to the arrangement of the resistance plates 25, the flow resistances of the ink INK in the second direction DR2 equal to an ink movement direction DR_INK are the same, and the flow resistance of the ink INK in the first direction DR1 substantially perpendicular to the ink movement direction DR_INK may be increased. That is, it may be difficult for the ink INK to move in the first direction DR1 due to the resistance plates 25.

According to some embodiments, the resistance plates 25 may be arranged to be spaced apart from each other in the first direction DR1 at the same first distance D1 (or separation distance). However, the arrangement of the resistance plates 25 is not limited thereto. For example, an interval between the resistance plates 25 at an end of the dispersion plate 24 (that is, an end in the first direction DR1) may be smaller than an interval between the resistance plates 25 at an area center of the dispersion plate 24 (that is, an area center in a plan view). Regarding the flow of the ink INK to be described with reference to FIG. 7, the resistance plates 25 may be relatively densely arranged at the end of the dispersion plate 24 (that is, the end in the first direction DR1).

According to some embodiments, the resistance plates 25 may be integrally formed with the dispersion plate 24. However, the resistance plates 25 are not limited thereto, and the resistance plates 25 may be manufactured separately from the dispersion plate 24 and may be coupled to the dispersion plate 24. This will be described in more detail below with reference to FIG. 9.

Meanwhile, in FIG. 5, the resistance plates 25 are illustrated as being located in a direction perpendicular to the first direction DR1 (that is, a moving direction of the ink INK in the manifold 22 illustrated in FIG. 4), but the resistance plates 25 are not limited thereto. For example, at least some of the resistance plates 25 may be located in a diagonal direction intersecting each of the first direction DR1 and the second direction DR2. That is, the resistance plates 25 may be arranged in various directions intersecting the first direction DR1 within a range capable of uniformly maintaining a density of the light-emitting elements LD (or solid material) in the ink INK by reducing the flow of the ink INK in the first direction DR1 under the dispersion plate 24.

Referring again to FIGS. 3 and 4, the head block 26 may be positioned under the dispersion plate 24 (that is, in the third direction DR3 with respect to the dispersion plate 24).

The head block 26 may include a plurality of channels CH (or chambers) and piezoelectric elements PZ.

The channels CH may be connected to and communicate with the manifold 22 via the filter 23 and the dispersion plate 24. As illustrated in FIG. 4, the channels CH may be arranged in a matrix structure in the first direction DR1 and the second direction DR2.

The piezoelectric elements PZ may be located adjacent to the channels CH, and may discharge the ink INK through the channels CH. As illustrated in FIG. 3, the piezoelectric elements PZ may be arranged to correspond to the channels CH, may contract and expand in response to a signal provided from the outside (for example, a control unit), and may press the corresponding channels CH to discharge a specific amount of ink INK.

The nozzle unit 27 may include the nozzles NZL which are located under the head block 26 (that is, in the third direction DR3 with respect to the head block 26) and are positioned to correspond to the channels CH of the head block 26, respectively.

The ink INK discharged through one of the nozzles NZL of the nozzle unit 27 via one of the channels CH of the head block 26 may be supplied to the emission area EMA described with reference to FIG. 2 (that is, one of pixels included in a display panel). That is, the ink INK may be supplied to the emission areas EMA of a substrate 100 through the nozzles NZL of the nozzle unit 27.

Figure 6:
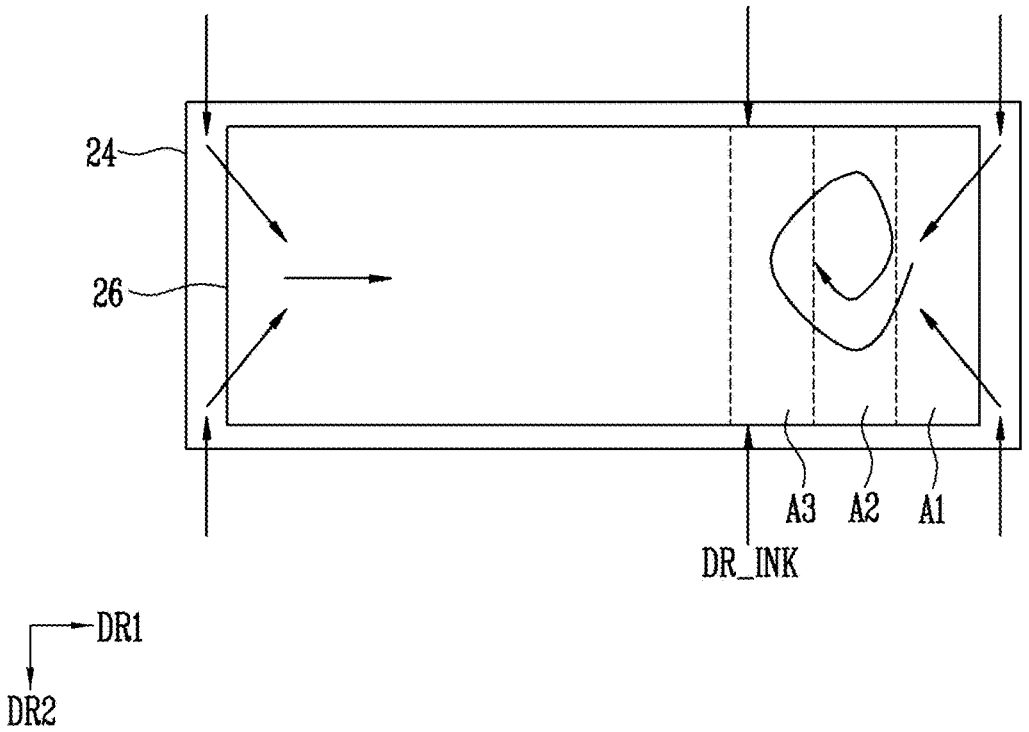
FIG. 6 is a view for describing a function of the resistance plates of FIG. 5 according to some embodiments.

Meanwhile, the planar size of the head block 26 may be the same as or different from the planar size of the dispersion plate 24. For example, as illustrated in FIG. 6, a length of the dispersion plate 24 in the first direction DR1 may be greater than a length of the head block 26 in the first direction DR1, and the head block 26 can be covered with the dispersion plate 24. In this case, the ink INK can be dispersed more widely through the dispersion plate 24 and supplied to the head block 26.

As described with reference to FIGS. 3 to 5, the print head unit 20 may include the dispersion plate 24 and the resistance plates 25 located between the manifold 22 and the head block 26. Thus, the ink INK moved in the first direction DR1 from the manifold 22 may be dispersed in the second direction DR2 through the dispersion plate 24 to be supplied to the upper surface of the head block 26. In addition, the ink INK may be prevented from flowing from the upper surface of the head block 26 in the first direction DR1 through the resistance plates 25. Therefore, solids (for example, the light-emitting elements LD) in the ink INK may be prevented from being concentrated in a specific area, and the ink INK having a uniform concentration (for example, the ink INK including a uniform number of light-emitting elements LD) may be discharged to the substrate 100 through the channels CH of the head block 26 and the nozzles NZL of the nozzle unit 27.

Figure 7:
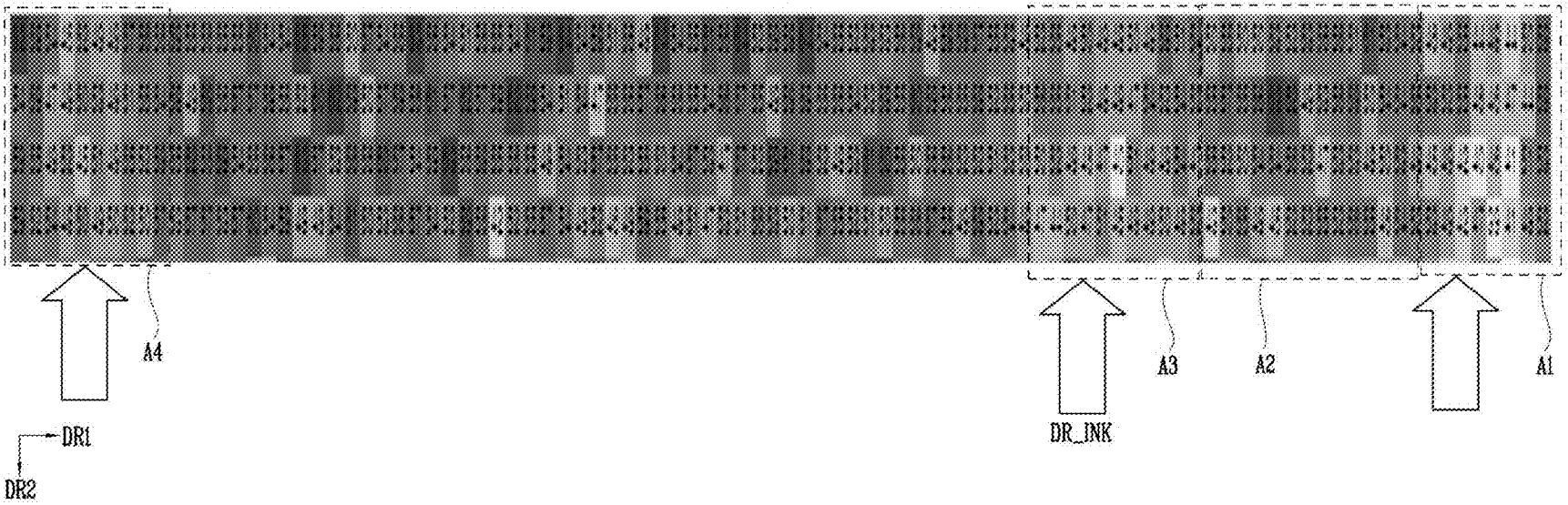
FIG. 7 is a view illustrating a comparative example of light-emitting elements supplied through the inkjet printer of FIG. 1 and aligned on a substrate.
Figure 8:
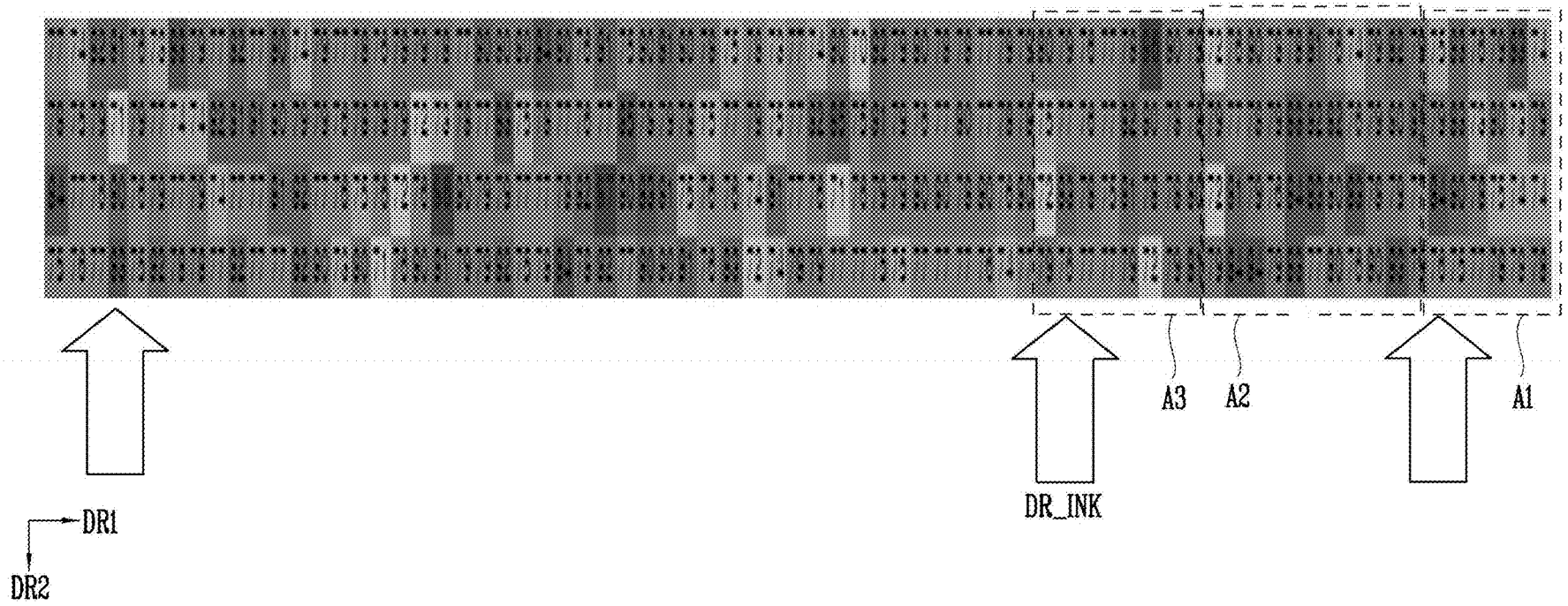
FIG. 8 is a view illustrating an example of light-emitting elements supplied through the inkjet printer of FIG. 1 and aligned on a substrate according to some embodiments.

FIG. 6 is a view for describing a function of the resistance plates of FIG. 5. A print head unit according to a comparative example may not include the resistance plates 25, and in this case, the flow of the ink INK supplied to the upper surface of the head block 26 is illustrated in FIG. 6. FIG. 7 is a view illustrating a comparative example of light-emitting elements supplied through the inkjet printer of FIG. 1 and aligned on a substrate. FIG. 8 is a view illustrating an example of light-emitting elements supplied through the inkjet printer of FIG. 1 and aligned on a substrate.

First, referring to FIGS. 3 to 6, the ink INK dispersed in the second direction DR2 through the dispersion plate 24 may be supplied to the upper surface of the head block 26 in the ink movement direction DR_INK.

The ink INK supplied to an area adjacent to an end (or both sides) of the head block 26 in the first direction DR1 (and a direction opposite to the first direction DR1) may be moved toward a center of an planar area of the head block 26. The end of the head block 26 in the first direction DR1 may be closed, and the inks INK moved from an upper side and a lower side of the head block 26 in the second direction DR2 may meet each other at a central portion of the head block 26 (that is, in an area between the upper side and the lower side of the head block 26), and thus, a flow of the ink INK may occur in the first direction DR1.

The flow of the ink INK may generate a vortex in an area adjacent to the end of the head block 26 in the first direction DR1. As illustrated in FIG. 6, due to a combination of the flow of the ink INK in a direction opposite to the first direction DR1 in a first area A1 and the flow of the ink INK in the first direction DR1 (and a direction opposite direction to the second direction DR2) in a second area A2 and a third area A3, the ink INK may rotate and move in the first to third areas A1 to A3.

As described with reference to FIG. 2, the ink INK includes the solvent SLV and the solids (for example, the light-emitting elements LD) contained in the solvent SLV. Due to the flow (or vortex) of the ink INK in the first direction DR1, the solvent SLV may easily move in the first direction DR1, but the solids may not relatively easily move in the first direction DR1. Due to a difference in moving characteristic between the solvent SLV and the solids, the concentration of the ink INK in areas in which a vortex occurs (for example, in the first area A1 and the third area A3) may be lower than the concentration of the ink INK in an area in which a vortex does not occur (or at a portion corresponding to a rotation axis of a vortex, for example, a central portion of the second area A2). That is, the concentration of the ink may be non-uniform INK on the upper surface of the head block 26.

Referring to FIGS. 1 and 4 to 7, FIG. 7 illustrates the concentration of the ink INK (for example, the number of the blight-emitting elements LD) supplied to the substrate 100 at a time through a print head unit not provided with the resistance plates 25.

As illustrated in FIG. 7, the number of the light-emitting elements LD supplied to the first area A1 and the third area A3 is 50 or less, which is smaller than 55 that is an average number of the light-emitting elements LD supplied to other areas (for example, the second area A2). Such a non-uniform distribution of the light-emitting elements LD may cause a luminance deviation of a display device including the substrate 100 and degrade image quality. For example, in the first area A1 and the third area A3 in which the number of the light-emitting elements LD is relatively small (thus, luminance is relatively low), a spot may be visible to a user.

Meanwhile, the number of the light-emitting elements LD supplied to a fourth area A4 positioned in a direction opposite to the first direction DR1 may also be 50 or less.

Meanwhile, the print head unit 20 according to some embodiments of the present invention may include the resistance plates 25 described with reference to FIG. 5 and may prevent the flow of the ink INK in the first direction DR1 between the dispersion plate 24 and the head block 26 through the resistance plates 25. Accordingly, it is possible to prevent the flow of the ink INK and the non-uniformity in the concentration of the ink INK caused by the flow in the first to third areas A1 to A3 (see FIG. 6).

Referring to FIGS. 1 and 4 to 8, FIG. 8 illustrates the concentration of the ink INK (for example, the number of the blight-emitting elements LD) supplied to the substrate 100 at a time through the print head unit 20 according to some embodiments of the present invention (that is, the print heat unit 29 provided with the resistance plates 25).

As illustrated in FIG. 8, the numbers of light-emitting elements LD supplied to the first to third areas A1 to A3 may be similar and may also similar to the number of the light-emitting elements LD supplied to other areas. That is, the relatively uniform distribution of the light-emitting elements LD may alleviate a luminance deviation of a display device including the substrate 100 and may alleviate or prevent a degradation of image quality.

As described with reference to FIGS. 6 to 8, the resistance plates 25 may prevent the ink INK from flowing in the first direction DR1 between the dispersion plate 24 and the head block 26, may make the concentration of the ink INK uniform on the upper surface of the head block 26, thereby making the concentration of the ink INK discharged through the print head unit 20 uniform.

Figure 9:
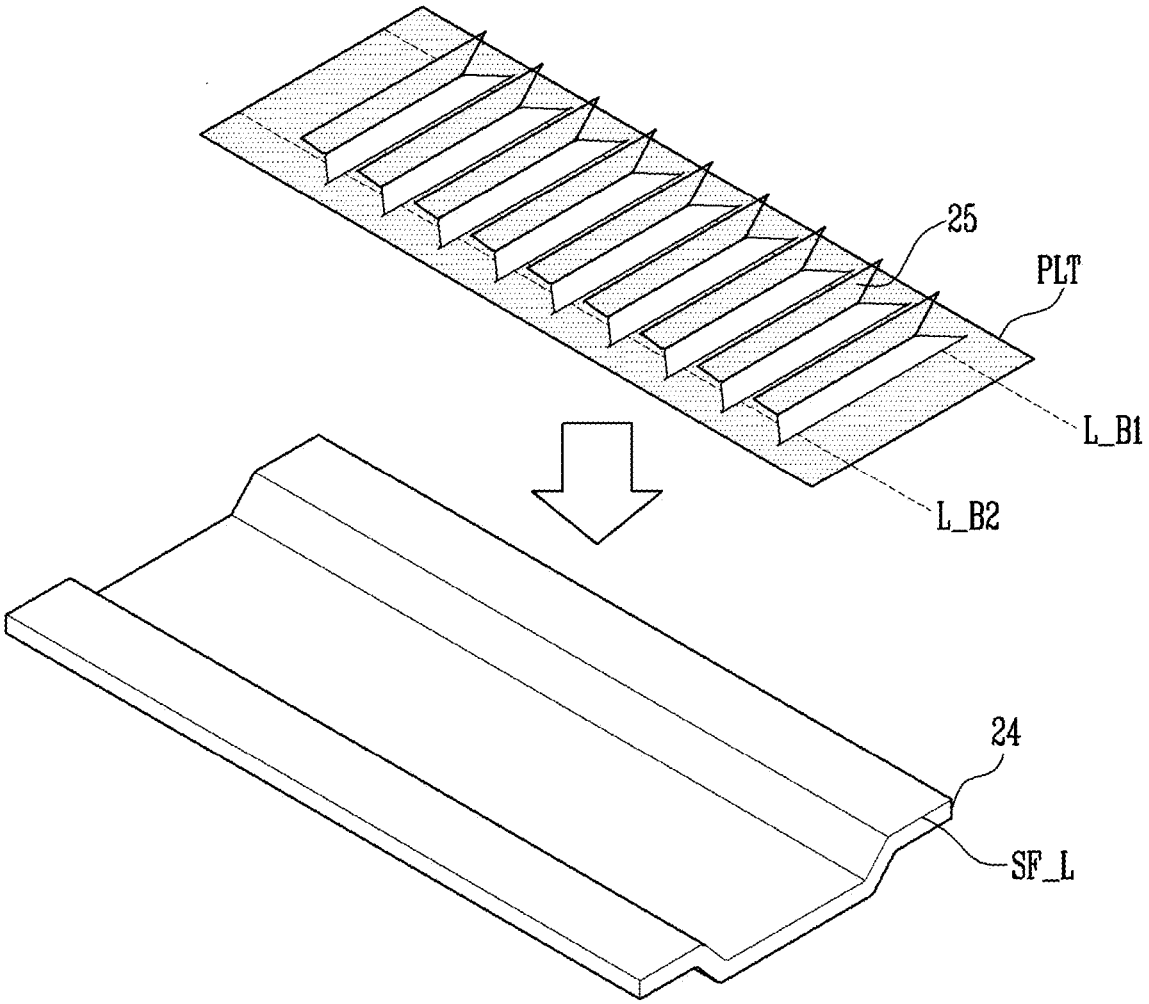
FIG. 9 is a view for describing a process of manufacturing the resistance plates of FIG. 5 according to some embodiments.

FIG. 9 is a view for describing a process of manufacturing the resistance plates of FIG. 5.

Referring to FIGS. 5 and 9, areas of a mother substrate PLT (for example, a metal plate) corresponding to the resistance plates 25 may be cut (or punched), and corresponding areas may be bent or curved, thereby forming the resistance plates 25. Thereafter, the mother substrate PLT may be bent based on a first virtual line L_B1 and a second virtual line L_B2 so that the mother substrate PLT may have the same or similar shape as the second surface SF_L of the dispersion plate 24. The mother substrate PLT on which the resistance plates 25 are formed may be coupled to the second surface SF_L of the dispersion plate 24 through an interference fit method or a separate coupling member.

As described with reference to FIG. 9, the resistance plates 25 can be easily manufactured through punching and bending processes for the mother substrate.

Figure 10:
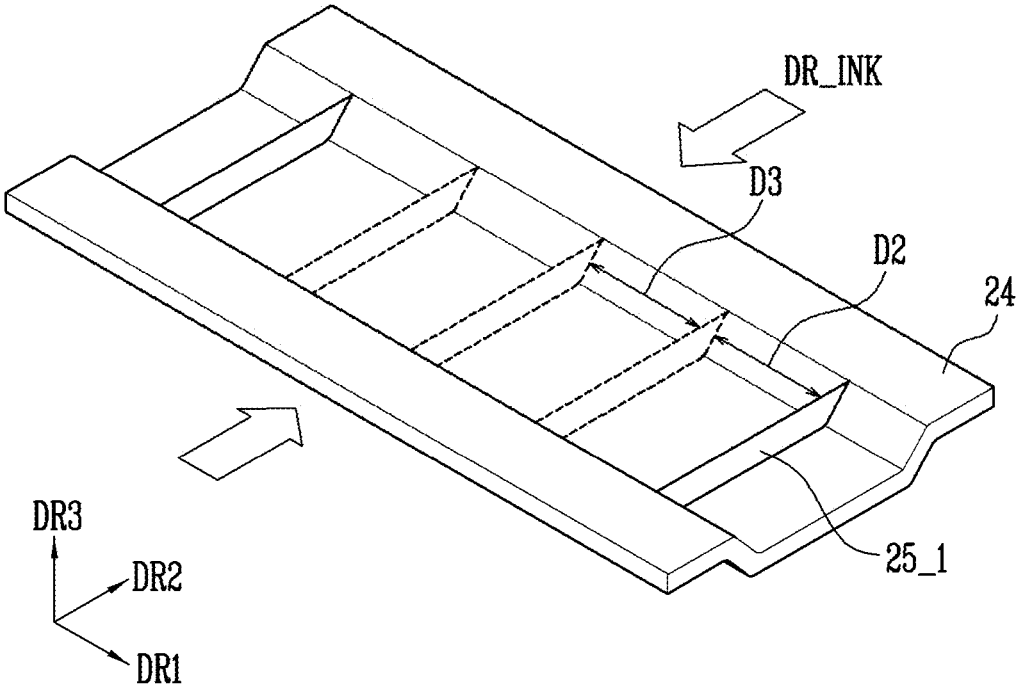
FIG. 10 is a perspective view illustrating resistance plates included in the print head unit of FIG. 4 according to some embodiments.

FIG. 10 is a perspective view illustrating another example of resistance plates included in the print head unit of FIG. 4. FIG. 10 illustrates a view corresponding to FIG. 5.

Referring to FIGS. 5 and 10, the resistance plates 25 illustrated in FIG. 5 are uniformly spaced apart from each other, but resistance plates 25_1 illustrated in FIG. 10 are arranged non-uniformly.

According to some embodiments, some of the resistance plates 25_1 may be located adjacent to an end (or both sides) of a dispersion plate 24 in a first direction DR1 (and in a direction opposite to the first direction DR1).

As described with reference to FIG. 6, the flow of an ink INK in the first direction DR1 between the dispersion plate 24 and a head block 26 may start in an area adjacent to the end (or both sides) of the dispersion plate 24 in the first direction DR1 (and a direction opposite to the first direction DR1), and the flow of the ink INK in the first direction DR1 may be greatest in a corresponding area.

Accordingly, in order to prevent the flow of ink INK in the first direction DR1 in an area adjacent to the end (or both sides) of the dispersion plate 24 in the first direction DR1 (and the direction opposite to the first direction DR1), the resistance plate 25_1 may be located adjacent to the end (or both sides) of the dispersion plate 24 in the first direction DR1 (and the direction opposite to the first direction DR1). According to some embodiments, the resistance plate 25_1 may be located only in an area adjacent to the end (or both sides) of the dispersion plate 24 in the first direction DR1 (and the direction opposite to the first direction DR1).

According to some embodiments, a distance between the resistance plates 25_1 in the area adjacent to the end (or both sides) of the dispersion plate 24 in the first direction DR1 (and the direction opposite to the first direction DR1) may be different from a distance between the resistance plates 25_1 in an area adjacent to a center of a planar area of the dispersion plate 24.

As illustrated in FIG. 10, in the area adjacent to the end (or both sides) of the dispersion plate 24 in the first direction DR1 (and the direction opposite to the first direction DR1, the resistance plate 25_1 may be spaced apart from each other by a second distance D2, and in the area adjacent to the center of the planar area of the dispersion plate 24, the resistance plates 25_1 may be spaced apart from each other by a third distance D3. Here, the third distance D3 may be greater than the second distance D2.

As described with reference to FIG. 6, the first to third areas A1 to A2 adjacent to the end (or both sides) of the dispersion plate 24 in the first direction DR1 (and the direction opposite to the first direction DR1), the flow of the ink INK in the first direction DR1 may be great. Accordingly, in consideration of the fact that the flow of the ink INK in the first direction DR1 is different for each area, in the area adjacent to the end (or both sides) of the dispersion plate 24 in the first direction DR1 (and the direction opposite to the first direction DR1), the resistance plates 25_1 may be separated by a relatively small second distance D2, and in the area adjacent to the center of the planar area of the dispersion plate 24, the resistance plates 25_1 may be separated by a relatively large third distance D3.

As described with reference to FIG. 10, the resistance plates 25_1 may be separated by a non-uniform distance.

In a print head unit and an inkjet printer including the same according to some embodiments of the present invention, a dispersion plate and resistance plates are located between a manifold and a head block. An ink moved in a first direction from the manifold may be dispersed in the second direction through the dispersion plate to be supplied to an upper surface of the head block, and the ink may be prevented from flowing in the first direction from the upper surface of the head block through the resistance plates. Accordingly, the concentration of solids (for example, light-emitting elements) in the ink may be prevented from becoming non-uniform due to the flow of the ink in the first direction, and the light-emitting elements may be uniformly supplied from the print head unit to a substrate.

The effects and characteristics of some embodiments of the present invention are not limited by the above-described contents, and more various effects are included in the present specification.

Although aspects of some embodiments of the present invention have been described, it is understood that the present invention should not be limited to these example embodiments but various changes and modifications can be made by one ordinary skilled in the art within the spirit and scope of the invention as hereinafter claimed.

Therefore, the technical scope of the present invention should not be limited to the contents described in the detailed description of the specification, but should be defined by the claims and their equivalents.

What is claimed is:

1. An inkjet printer comprising:

a stage;

a substrate on the stage;

a print head unit above the stage and configured to discharge an ink to the substrate; and an ink supply unit configured to supply the ink to the print head unit, wherein the print head unit includes:

a manifold configured to guide movement of the ink in a first direction therein;

a head block under the manifold and including a plurality of channels connected to the manifold and piezoelectric elements adjacent to the channels to discharge the ink through the channels;

a nozzle unit under the head block and including nozzles corresponding to the channels;

a dispersion plate between the manifold and the head block and configured to disperse the ink in a second direction intersecting the first direction to supply the ink to the head block; and a plurality of resistance plates between the dispersion plate and the head block, formed parallel to the second direction, and configured to prevent the ink from flowing in the first direction.

2. The Inkjet printer of claim 1, wherein the ink includes a solid dispersed in a solvent, and wherein the solid is at least one selected from light-emitting elements, quantum dots, and color filter materials, each of which has a diameter or a length ranging from a nanoscale to a microscale.

3. The inkjet printer of claim 1, wherein a first surface of the dispersion plate adjacent to the manifold is inclined along the second direction, and wherein the ink supplied to the dispersion plate is supplied between the dispersion plate and the head block along the first surface.

4. The inkjet printer of claim 3, wherein a second surface of the dispersion plate adjacent to the head block includes a central portion and a peripheral portion positioned in the second direction with respect to the central portion, wherein the central portion is higher than the peripheral portion with respect to an upper surface of the head block, and wherein the resistance plates are at the central portion.

5. The inkjet printer of claim 4, wherein the resistance plates are arranged at an equal interval along the first direction.

6. The inkjet printer of claim 4, wherein a length of the dispersion plate in the first direction is greater than a length of the head block in the first direction, and wherein the dispersion plate covers the head block in the first direction.

7. The inkjet printer of claim 4, wherein some of the resistance plates are adjacent to both sides of the dispersion plate in the first direction.

8. The inkjet printer of claim 4, wherein a distance between the resistance plates in an area adjacent to a side of the dispersion plate in the first direction is different from a distance between the resistance plates in an area adjacent to a central portion of a planar area of the dispersion plate.

9. The inkjet printer of claim 1, wherein the resistance plates are integrally formed with the dispersion plate.

10. The inkjet printer of claim 1, wherein the resistance plates are formed by bending from a mother substrate parallel to a lower surface of the dispersion plate, and wherein the mother substrate is coupled to the dispersion plate.

11. The inkjet printer of claim 1, wherein the print head unit further includes a filter between the manifold and the dispersion plate.

12. A print head unit comprising:

a manifold configured to guide movement of an ink in a first direction therein;

a head block under the manifold and including a plurality of channels connected to the manifold and piezoelectric elements adjacent to the channels to discharge the ink through the channels;

a nozzle unit under the head block and including a plurality of nozzles corresponding to the channels;

a dispersion plate between the manifold and the head block and configured to disperse the ink in a second direction intersecting the first direction to supply the ink to the head block; and a plurality of resistance plates between the dispersion plate and the head block, formed parallel substantially to the second direction, and configured to prevent the ink from flowing in the first direction.

13. The print head unit of claim 12, wherein a first surface of the dispersion plate adjacent to the manifold is inclined along the second direction, and wherein the ink supplied to the dispersion plate is supplied between the dispersion plate and the head block along the first surface.

14. The print head unit of claim 13, wherein a second surface of the dispersion plate adjacent to the head block includes a central portion and a peripheral portion positioned in the second direction with respect to the central portion, wherein the central portion is higher than the peripheral portion with respect to an upper surface of the head block, and wherein the resistance plates are at the central portion.

15. The print head unit of claim 14, wherein the resistance plates are arranged at an equal interval along the first direction.

* * * * *